US005829117A

United States Patent [19]

Okawa et al.

[11] Patent Number: 5,829,117

[45] Date of Patent: Nov. 3, 1998

[54] HOT SAW CUTTING TYPE CONTINUOUS ROLLING METHOD AND APPARATUS THEREOF

[75] Inventors: Susumu Okawa; Giichi Matsuo, both of Yokohama, Japan

[73] Assignee: NKK Corporation, Tokyo, Japan

[21] Appl. No.: 792,435

[22] Filed: Jan. 30, 1997

[30] Foreign Application Priority Data

Feb. 23, 1996 [JP] Japan ..... 8-035954

[51] Int. Cl.[6] ..... B21B 1/46

[52] U.S. Cl. ..... 29/527.6; 29/33 C; 29/527.5; 164/459; 164/460

[58] Field of Search ..... 29/527.6, 527.5, 29/33 C; 164/459, 460

[56] References Cited

FOREIGN PATENT DOCUMENTS

| | | |
|---|---|---|
| 0761328 A1 | 3/1997 | European Pat. Off. . |
| 0761330 A1 | 3/1997 | European Pat. Off. . |
| 64393 | 9/1892 | Germany . |
| 2836338 | 2/1980 | Germany . |
| 4009861 A1 | 10/1991 | Germany . |
| 52-43754 | 4/1977 | Japan . |

OTHER PUBLICATIONS

Patent Abtracts of Japan, vol. 003 No. 027 (C–039), 1979 & JP 54 001264 A (Nippon Steel Corp.) Jan. 8, 1979.

Patent Abstracts of Japan, vol. 015 No. 294 (M–1140), Jul. 25, 1991 & JP 03 106508 A (NKK Corp.), May 7, 1991.

Patent Abstracts of Japan, vol. 004, No. 016 (C–072), Feb. 7, 1980 & JP 54 153750 A (Toshiba Corp). Dec. 4, 1979.

Database WPI, Section Ch. Week 7809 Derwent Publications Ltd., London, GB; Class 21, An 78–16601A & JP 53 005 060 A (Mitsubishi Electric Corp.), Jan. 18, 1978.

Patent Abtracts of Japan, vol. 007, No. 079 (M–204), Mar. 31, 1983 & JP 58 006702 A (Nippon Kokan KK), Jan. 14, 1983.

*Primary Examiner*—Carl J. Arbes

*Attorney, Agent, or Firm*—Frishauf, Holtz, Goodman, Langer & Chick

[57] ABSTRACT

A hot saw cutting type continuous rolling method comprises casting two strand billets continuously; cutting the billets to predetermined length by hot saws; directly feeding billet portions obtained by cutting onto a rolling line via a line connecting device; continuously welding and joining the billets portions by a flash butt welder to form a continuous billet; grinding and removing burrs at the welded portion of the continuous billet by a grinding machine; and continuously rolling the billet by a rolling mill group, after heating the continuous billet to a higher temperature by an induction heater. A hot saw cutting type continuous rolling apparatus is provided for performing the above-described method.

5 Claims, 3 Drawing Sheets

HOT SAW CUTTING TYPE CONTINUOUS ROLLING METHOD AND APPARATUS THEREOF

BACKGROUND OF THE INVENTION

1. Field of the Invention

The present invention relates to a continuous rolling method of a billet directly fed from a continuous casting machine, and, more particularly, to a continuous rolling method and apparatus in which after two billet strands have been directly fed and cut by a hot saw, the billet portions obtained by cutting are welded together by flash butt welding, followed by burr grinding, after which the resulting billet is heated to a higher temperature by induction heating to roll the billet.

2. Description of the Related Art

The billet continuous rolling method is known as an energy-saving rolling method for efficiently producing a wire rod, steel bar, or shaped steel. For example, in the billet continuous rolling method disclosed in Japanese Unexamined Patent Publication No. 52-43754, a billet, directly fed from a continuous casting machine, is cut into a predetermined length by a hot saw, followed by temporary cooling of the billet portions obtained by cutting to reheat the cooled billet portions in a heating furnace. Then, the reheated billet portions are welded together by a flash butt welder, after which the burr on welded portion is peeled off by a forming tool disposed on a scarfer. Thereafter, the continuous billet is heated to the required temperature for rolling by an induction heater to roll the heated continuous billet by a group of rolling mill.

However, in such a conventional continuous rolling method, the billet must be heated by about 1000° C., from room temperature of 20° C. to a final rolling required temperature of 1020° C, thereby considerably increasing heating costs. In addition, a difference between the continuous casting capacity and the rolling capacity prevents direct connection of a billet casting line and a billet rolling line, which inevitably results in huge facilities and makes it necessary to use a large space. Further, a forming tool is used for removing burrs from the billet flash butt welded portion, so that the forming tool has a short tool life and continuous operation cannot be performed, when a step is formed at the billet welded portion, since it is difficult to perform burr removal in such a case.

SUMMARY OF THE INVENTION

The present invention aims to solve the above-described problem and to provide continous rolling method and apparatus thereof to make it possible to further save energy and space, and achieve higher efficiency.

A hot saw cutting type continuous rolling method of the present invention comprises the steps of casting two strand billets continously; cutting the billets to predetermined length by a hot saw; directly feeding billet portions obtained by cutting to a billet rolling line through means of a line connecting device; continously welding and joining the billets portions by a flash butt welder; grinding and removing burrs at the welded billet portion by a grinding machine; heating the continuous billet to a higher temperature by an induction heater; and continuously rolling the billet by a rolling mill group.

Firstly, a hot saw cutting type continuous rolling apparatus comprises: a continuous casting machine for casting two strand billets; traveling-type hot saws disposed on their respective casting lines; a line connecting device including means for alternately performing transverse feeding of the billet portions obtained by cutting, disposed between the casting lines and a rolling line; a traveling-type flash butt welder for continously welding and joining the billet portions to form a continuous billet, disposed at a downstream side of the line connecting device; a traveling-type grinding machine for removing burrs at the welded portion of the continous billet, disposed at a downstream side of the traveling-type flash butt welder; an induction heater for heating the continous billet to higher temperature, disposed at a downstream side of the traveling-type grinding machine; and a rolling mill group for rolling the continous billet which was heated to said higher temperature.

Secondly, a hot saw cutting type continuous rolling apparatus comprises: a continuous casting machine for casting two strand billets; traveling-type hot saws disposed on their respective casting lines; a line connecting device including means which rotates by a predetermined angle for alternately performing transverse feeding of billet portions by cutting, disposed between the casting lines and a rolling line; a traveling-type flash butt welder for continously welding and joining the billet portions to form a continuous billet, disposed at a downstream side of the line connecting device; a traveling-type grinding machine for removing burrs at the welded portion of the continous billet, disposed at a downstream side of the traveling-type flash butt welder; an induction heater for heating the continous billet to a higher temperature, disposed at a downstream side of the traveling-type grinding machine; and a rolling mill group for rolling the continous billet which was heated to said higher temperature.

DESCRIPTION OF THE PREFERED EMBODIMENT

Figure 1:
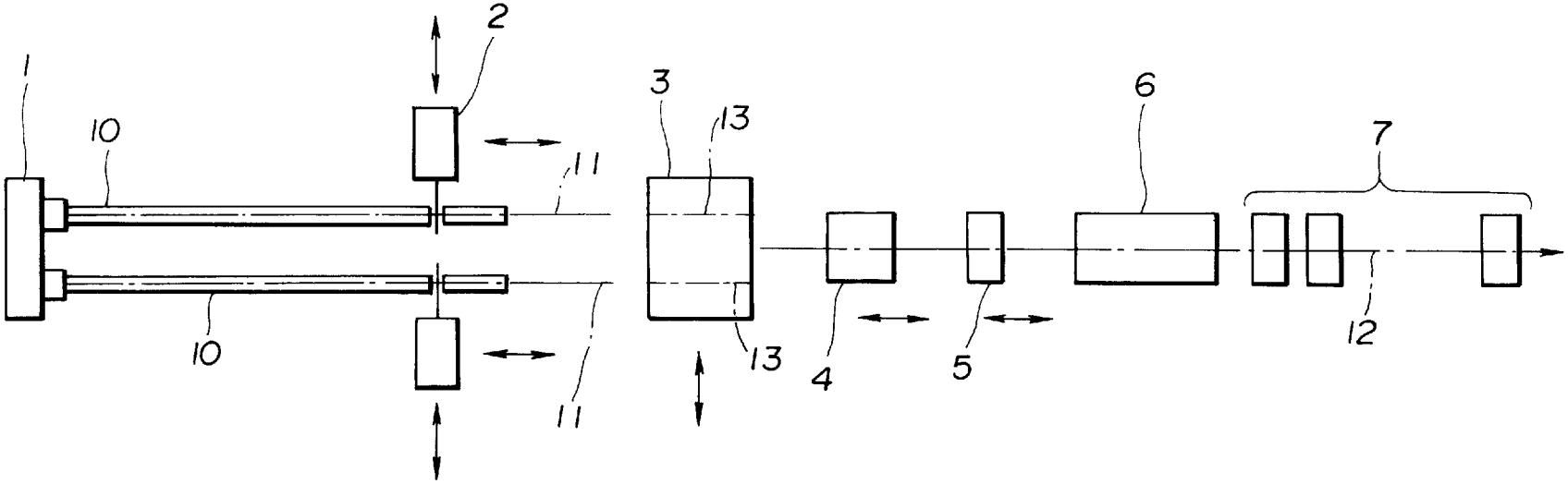
FIG. 1 is a schematic view of a continuous rolling production line in accordance with the present invention.

FIG. 1 is a schematic view of a continuous rolling production line of the present invention. Referring to FIG. 1, reference numeral 1 denotes a continuous casting machine for continuously casting two strands of billets 10 to directly feed the casted billets along two parallel casting lines 11. A rolling line 12 is directly connected to the casting lines 11 by means of a line connecting device 3. The rolling line 12 is interposed midway between the two casting lines 11. The line connecting device 3, which includes two parallel billet transfer lines 13 in line with the casting lines 11, is alternately shifted transversely to intermittently connect either one of the casting lines 11 to the rolling line 12.

Reference numerals 2 denotes hot saws, disposed on their respective casting lines 11 at the upstream side of the line connecting device 3, which travel in synchronization with the billets to perform cutting operations. The billets are usually cut into a length of from 10 to 15 meters. The billet may be circular or square-shaped in section, with the sectional size determined by the balanced values of the continuous casting and rolling capacities. The hot saws 2 alternately perform cutting operations on the two strand billets.

At the downstream side of the line connecting device 3 and on the same line as the rolling line 12 are disposed a flash butt welder 4, a grinding machine 5, and an induction heater 6. In addition, a rolling mill group 7, which forms the rolling line 12, is also disposed at the downstream side.

The flash butt welder 4 travels in synchronization with the billets to weld and join together the rear end face (cutting face) of the preceding billet portion and the front end face (cutting face) of the succeeding billet portion by flash butt welding. The cut billet portions are joined together by performing the above-described welding.

The grinding machine 5 also travels in synchronization with the billets to grind and deburr the flash butt welded portion. If deburring is not performed, flaws remain on the product.

The induction heater 6 is used for heating the continuous billet to the required temperature for rolling of about 1020° C.

The rolling mill group 7 comprises a roughing train, an intermediate train, and a finishing train, which are used to perform hot rolling on the continuous billet to produce the desired product.

In the continuous rolling method, the two strands of billets 10, directly fed from the continuous casting machine 1, are alternately cut by the traveling-type hot saws 2 into the predetermined lengths in order to transfer the preceding billet portion onto one of the billet transfer line 13 of the line connecting device 3, after which the line connecting device 3 is shifted transversely to directly connect the transfer line 13 to the rolling line 12, followed by transfer of the preceding billet portion onto the rolling line 12. After the preceding billet portion has been transferred onto the rolling line 12, the succeeding billet portion is transferred onto the rolling line 12 by shifting the line connecting device 3 in the opposite direction, and directly connecting the other billet transfer line 13 to the rolling line 12. The timing in which the line connecting device 13 receives the preceding billet and succeeding billet portions is taken in synchronization with the timing in which the line connecting device 3 shifts. The line connecting device 3 may comprise a chain conveyor which intermittently run transversely.

Then, the cut billet portions are welded together by the traveling-type flash butt welder 4 which weld together the preceding and succeeding billet portions. Since the end faces of the billets are cut at right angles, without any irregularities, by the hot saws 2, a smaller portion of the cutting face needs to be removed by flashing, thereby reducing the welding time, so that the welding time which takes about 25 seconds when the cutting faces are not aligned, takes only about 15 seconds.

Figure 2:
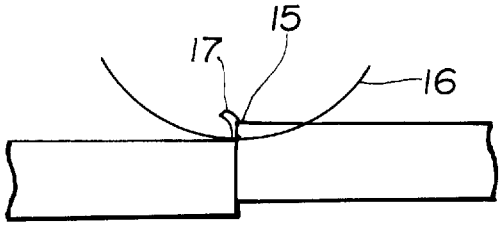
FIG. 2 is a view of the grinding condition of the welding portion with a step.

Thereafter, the burrs produced at the welded portion are ground by the travelling-type grinding machine 5. As shown in FIG. 2, even if there is a step 15 at the welded portion, the burr 17 can be removed because deep grinding can be performed to a certain extent by a grindstone 16. Conventional forming tools leave ground burrs, because a gap must be provided. In addition, a gap of the improper size may cause the tip of the cutting tool to hit the step and break.

The continuous billet formed thus is transferred into the induction heater 6 which heats the billet to the required temperature for rolling of about 1020° C. Since the temperature at the output side of the continuous casting machine 1 is about 920° C., the billet needs to be heated by only about 100° C., thereby greatly reducing the heating costs.

Thereafter, the billet is continuously rolled by the rolling mill group 7 to thereby produce a product.

Embodiment 1

Figure 3:
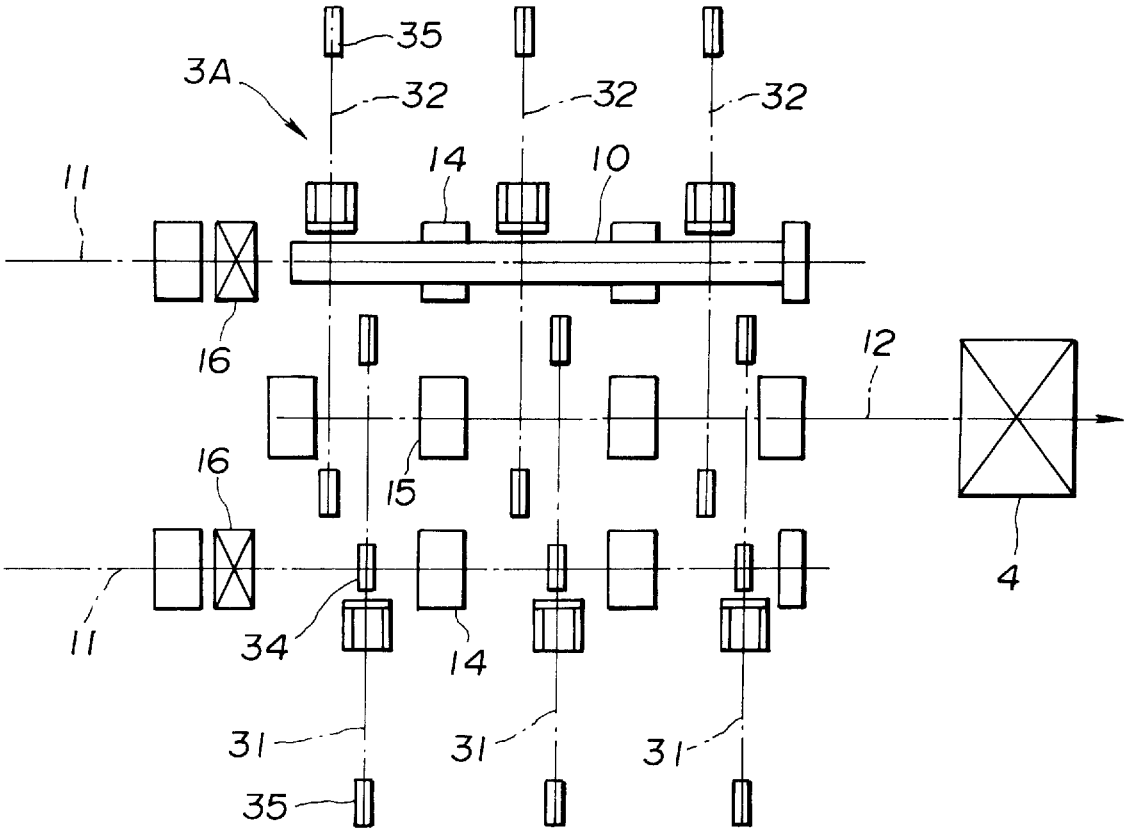
FIG. 3 is a schematic plan view of the main portion of a continuous rolling production line of Embodiment 1 in accordance with the present invention.
Figure 4:
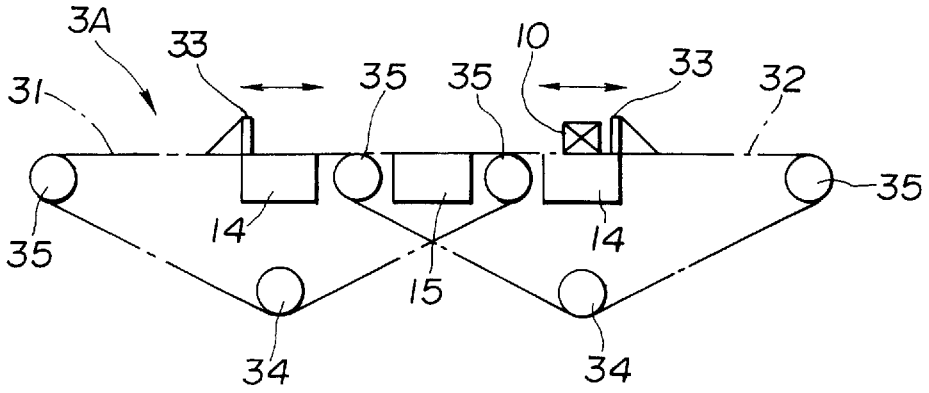
FIG. 4 is a schematic front view of the line connecting device of FIG. 3.

FIG. 3 is a schematic plan view illustrating the main portion of a production line in Embodiment 1 of the present invention, while FIG. 4 is a front view of the line connecting device thereof.

As mentioned above, the line connecting device may take the form of a chain conveyor. In the present embodiment, such a chain conveyor type line connecting device 3A is shown.

The line connecting device 3A comprises first chains 31 and second chains 32 wound so as to oppose each other in the transverse direction, with the rolling line interposed therebetween. Dogs 33 are provided for each of the chains 31 and 32 for pushing transversely the billets 10 cut by the hot saw. Accordingly, the line connecting device 3A comprises pairs of first chains 31 and second chains 32 arranged in a plurality of rows. The upper portions of the chains 31 and chains 32 are supported by supporting members (not shown). In the figures, reference numerals 34 denote drive chain wheels, reference numerals 35 denote driven chain wheels, reference numerals 14 denote conveyor rollers forming the casting lines 11, reference numerals 15 denote conveyor rollers forming the rolling line 12, and reference numerals 16 denote disappearing stoppers disposed on the casting lines 11. The other component parts are the same as those of FIG. 1.

In order to carry out continuous rolling at a time cycle of, for example, 60 seconds, it is important to reduce the transversely shifting time of the billets 10 by the line connecting device, so that in the present embodiment a line connecting device 3A comprising a plurality of pairs of first chains 31 and second chains 32 is disposed in order to alternately feed transversely the billets 10 cut by the hot saw from the casting line to the rolling line 12 in a short time. More specifically, the billet 10 portions can be very easily fed to the rolling line 12 by simply reciprocating the dogs 33 between the casting lines 11 and the rolling line 12.

Embodiment 2

Figure 5:
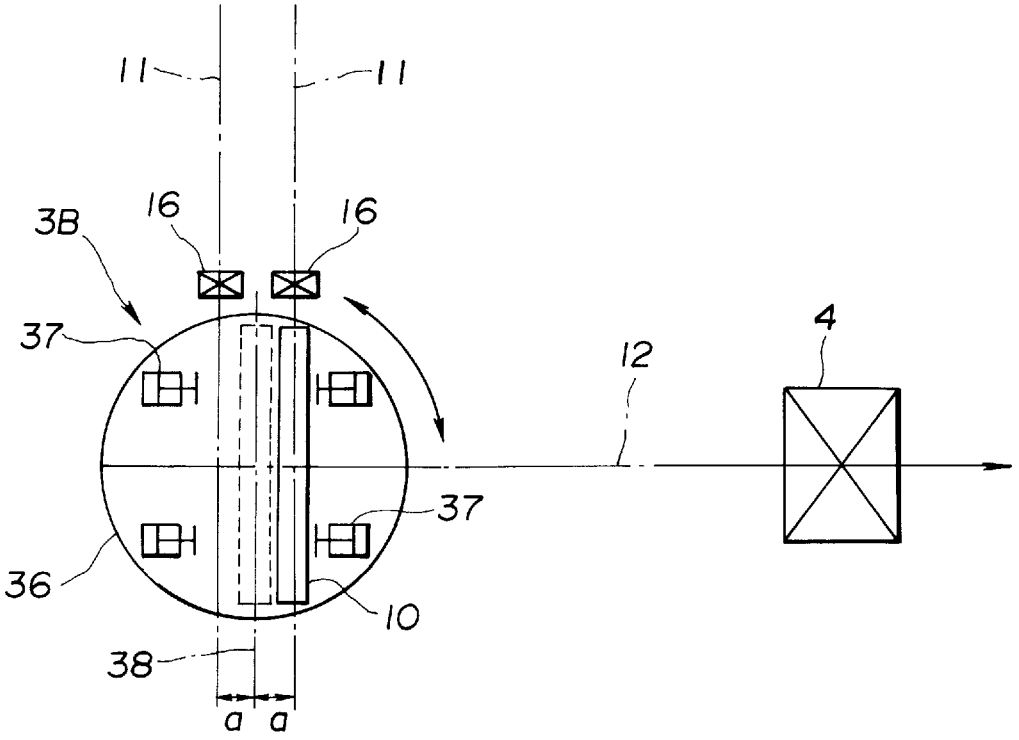
FIG. 5 is a schematic plan view of the main portion of a continuous rolling production line of Embodiment 2 in accordance with the present invention.

FIG. 5 is a schematic plan view of the main part of the production line in Embodiment 2 of the present invention. In the present embodiment, a turntable type line connecting device 3B is shown. While a turntable 36 is rotating to a predetermined angle (such as 90°), the billet 10 portion, transferred from one of the casting lines 11 onto a turntable 36, is shifted onto a rotational centerline 38 of the turntable 36 (by an amount represented by stroke a in FIG. 5) by a transversely pushing device 37 (such as a cylinder device disposed on the turntable 36). When the turntable 36 is rotated 90 degrees, the billet portion 10 on the turntable 36 can be transferred onto the rolling line 12, since the rolling line is disposed in the direction of rotation thereof.

The turntable type line connecting device 3B is suited for placing the billet portion 10 when the direction of the casting line 11 and the direction of the rolling line 12 are different. Though the angle between the lines 11 and 12 can be set at any angle, the connecting time (equal to the sum of the rotation time of the turntable 36 and the billet shifting time)

actually limits the angle setting, so that the preferred angle is within 90 degrees.

According to the present invention, a billet casting line and a rolling line are intermittently connected together by a line connecting device, thereby eliminating the need for a heating furnace, as has been conventionally the case, and allowing effective use of the heat of the billets. Therefore, heating costs are greatly reduced, since the induction heater needs to heat the billets by only about 100° C. from about 920° C. at the output side of the continuous casting machine to about 1020° C. rolling temperature.

Two billet strands are subjected to continuous casting, since when only one strand is subjected to continuous casting, it becomes difficult to balance the continuous casting capacity and the continuous rolling capacity. The continuous casting capacity and the continuous rolling capacity are balanced in an efficient manner by connecting the two strand casting lines and the one strand rolling line by a line connecting device interposed therebetween. On the other hand, when three or more strands are to be subjected to continuous casting, a hot saw, which interferes with another hot saw on the casting line, cannot be placed.

In addition, since a hot saw is used for cutting operations, the cutting face is cut at right angles and has no irregularities, thereby reducing the welding time of the flash butt welder.

A grinding machine is used for grinding the burrs at the welded portion, so that the tool life thereof is long, and burr removal is possible, even when a step is formed at the welded portion, since a relatively deep grinding operation can be performed.

As described above, the billet casting lines and the billet rolling line are intermittently connected by a line connecting device, thereby eliminating the need for a billet heating furnace, so that energy is effectively saved and heating costs are greatly reduced. In addition, since two strands of billets are directly fed, the line connecting device allows the continuous casting capacity and the rolling capacity to be efficiently balanced. It is possible to save space compared to conventional facilities. Further, the flash butt welding time is reduced, thereby prolonging the life of the grinding machine, and satisfactorily allowing continuous rolling.

What is claimed is:

1. A hot saw cutting type continuous rolling method comprising the steps of:

casting two strand billets continously;

cutting the billets to predetermined length by hot saws;

directly feeding billet portions obtained by cutting to a billet rolling line through means of a line connecting device;

continously welding and joining the billets portions by a flash butt welder to form a continuous billet;

grinding and removing burrs at the welded billet portion by a grinding machine;

heating the continuous billet to a higher temperature by an induction heater; and continuously rolling the billet by a rolling mill group.

2. A hot saw cutting type continuous rolling apparatus comprising:

a continuous casting machine for casting two strand billets;

traveling-type hot saws disposed on their respective casting lines;

a line connecting device including means for alternately performing transverse feeding of billet portions obtained by cutting, disposed between the casting lines and a rolling line;

a traveling-type flash butt welder for continuously welding and joining the billet portions to form a continuous billet, disposed at a downstream side of the line connecting device;

a traveling-type grinding machine for removing burrs at the welded portion of the continuous billet, disposed at a downstream side of the traveling-type flash butt welder;

an induction heater for heating the continuous billet to a higher temperature, disposed at a downstream side of the traveling-type grinding machine; and a rolling mill group for rolling the continuous billet which was heated to said higher temperature.

3. The apparatus of claim 2, wherein the line connecting device comprises:

a first chain conveyor disposed at one side of the rolling line, transversely feeding the billet on one casting line onto the rolling line; and a second chain conveyor disposed at another side of the rolling line, transversely feeding the billet on another casting line onto the rolling line.

4. A hot saw cutting type continuous rolling apparatus comprising:

a continuous casting machine for casting two strand billets;

traveling-type hot saws disposed on their respective casting lines;

a line connecting device including means which rotates by a predetermined angle for alternately performing transverse feeding of billet portions obtained by cutting, disposed between the casting lines and a rolling line;

a traveling-type flash butt welder for continuously welding and joining the billet portions to form a continuous billet, disposed at a downstream side of the line connecting device;

a traveling-type grinding machine for removing burrs at the welded portion of the continuous billet, disposed at a downstream side of the traveling-type flash butt welder;

an induction heater for heating the continuous billet to a higher temperature, disposed at a downstream side of the traveling-type grinding machine; and a rolling mill group for rolling the continuous billet which was heated to said higher temperature.

5. The apparatus of claim 4, wherein the line connecting device comprises:

a turntable which reciprocately rotates by a predetermined angle; and means for transversely pushing the billet portion on the turntable onto a centerline of rotation of the turntable.

* * * * *